US005532911A

United States Patent [19]

Sutherland

[11] Patent Number: 5,532,911

[45] Date of Patent: Jul. 2, 1996

[54] LIGHTING FIXTURE BARRIER WITH LAMP INSERTION CHANNEL

[75] Inventor: Ralph W. Sutherland, Blacksburg, Va.

[73] Assignee: Hubbell Incorporated, Orange, Conn.

[21] Appl. No.: 474,170

[22] Filed: Jun. 7, 1995

[51] Int. Cl.[6] ..... F21S 3/00

[52] U.S. Cl. ..... 362/220; 362/217; 362/429

[58] Field of Search ..... 362/217, 220, 362/260, 429

[56] References Cited

U.S. PATENT DOCUMENTS

| | | | |
|---|---|---|---|
| 3,097,903 | 7/1963 | Moore | 362/217 |
| 3,832,540 | 8/1974 | Roth . | |
| 3,911,265 | 10/1975 | Landrum et al. . | |
| 4,161,019 | 7/1979 | Mulvey | 362/220 |
| 4,288,846 | 9/1981 | Fletcher et al. | 362/217 |
| 4,498,126 | 2/1985 | Hernandez | 362/220 |
| 4,803,600 | 2/1989 | Pepping | 362/217 |
| 4,918,582 | 4/1990 | McIngvale, Jr. et al. | 362/217 |
| 5,109,323 | 4/1992 | Waycaster | 362/217 |

*Primary Examiner*—Denise L. Gromada
*Assistant Examiner*—Sara Sachie Raab
*Attorney, Agent, or Firm*—Jerry M. Presson; Mark S. Bicks

[57] ABSTRACT

A lighting fixture housing has a lamp cavity and two electrical sockets adjacent the opposite sides of the housing in the lamp cavity. Side barriers are adjacent the opposite sides and overlie the sockets such that each socket is located between a barrier and a housing side and is recessed behind the barrier by a distance. Lamp receiving openings in the barriers are coaxially aligned with the sockets to permit a lamp to extend through the openings and connect the lamp to the sockets. A channel in one barrier has a first portion extending along a peripheral edge of the barrier and a second portion extending from the first portion and terminating in the lamp receiving opening of the barrier.

12 Claims, 1 Drawing Sheet

LIGHTING FIXTURE BARRIER WITH LAMP INSERTION CHANNEL

FIELD OF THE INVENTION

The present invention relates to a lighting fixture with reflective barriers on opposite sides of the fixture housing with openings in the barriers to provide access to lamp sockets recessed behind the barriers. More particularly, the present invention relates to a lamp entry channel in at least one barrier extending along the barrier peripheral edge and terminating in the barrier access opening.

BACKGROUND OF THE INVENTION

Lighting fixtures for high intensity discharge lamps have housings with reflectors mounted on the opposite sides and the back of the lamp cavity. The lamps have elongated tubular configurations with conductive terminals at the opposite longituding ends. The lamp end terminals are coupled to electrical sockets mounted adjacent the housing sides to mount the lamp operatively in the lighting fixture.

Increased safety requirements have been applied to lighting fixtures utilizing double-end quartz lamps. When the lamps are replaced, the installer is exposed to electrical shock when the lighting fixture circuit is energized. The shock can occur if the installer touches a free end of the lamp bearing the conductive terminal during installation into the sockets. This hazard is particularly present for fixtures in which the lamp is removed and installed through a front face of the lighting fixture.

SUMMARY OF THE INVENTION

An object of the present invention is to provide a lighting fixture with reflective barriers, behind which the sockets are recessed, wherein the shock hazard during installation of a bulb is minimized when the lighting fixture circuit is energized.

Another object of the present invention is to provide a lighting fixture which can be adapted to minimize the shock hazard during relamping simply and effectively.

The foregoing objects are basically provided by a lighting fixture for a double-ended lamp comprising a housing, first and second electrical sockets, and first and second barriers. The housing defines a lamp cavity between opposite sides and top and bottom ends of the housing. The electrical sockets are adjacent the opposite sides of the housing for receiving and making electrical connection with the lamp end connectors. The first socket faces the second socket in the lamp cavity. The side barriers are adjacent the opposite sides and overlie the sockets such that each socket is located between the respective housing side and the respective barrier and is recessed behind the respective barrier by a predetermined distance. First and second openings are coaxially aligned with the sockets along the lamp axis to permit the lamp to extend through the openings and connect the lamp to the sockets. A channel formed in the first barrier has a first channel portion extending along a peripheral edge of the barrier adjacent one of the housing ends, and a second portion extending from the first portion and terminating at the first opening in the first barrier.

By forming the lighting fixture in this manner, one lamp end connector can be initially placed in one of the sockets. The other lamp end connector can then be slid through the channel to a position opposite the other socket. When both lamp ends are finally inserted into the sockets, both the lamp end connectors and the sockets are fully recessed behind the side barriers such that the installers hands cannot contact either the sockets or the lamp end connectors. The side barriers, in separating the installers hands from the lamp end connectors and fixture sockets, minimize the shock hazard.

Moreover, locating the channel along the peripheral edge of the barrier causes the lamp end connector to follow a longer path. Additionally, the lamp sockets can be further recessed behind the side barriers to provide greater protection against the shock hazard. This side barrier structure can be simply and easily incorporated into conventional lighting fixture configurations. Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
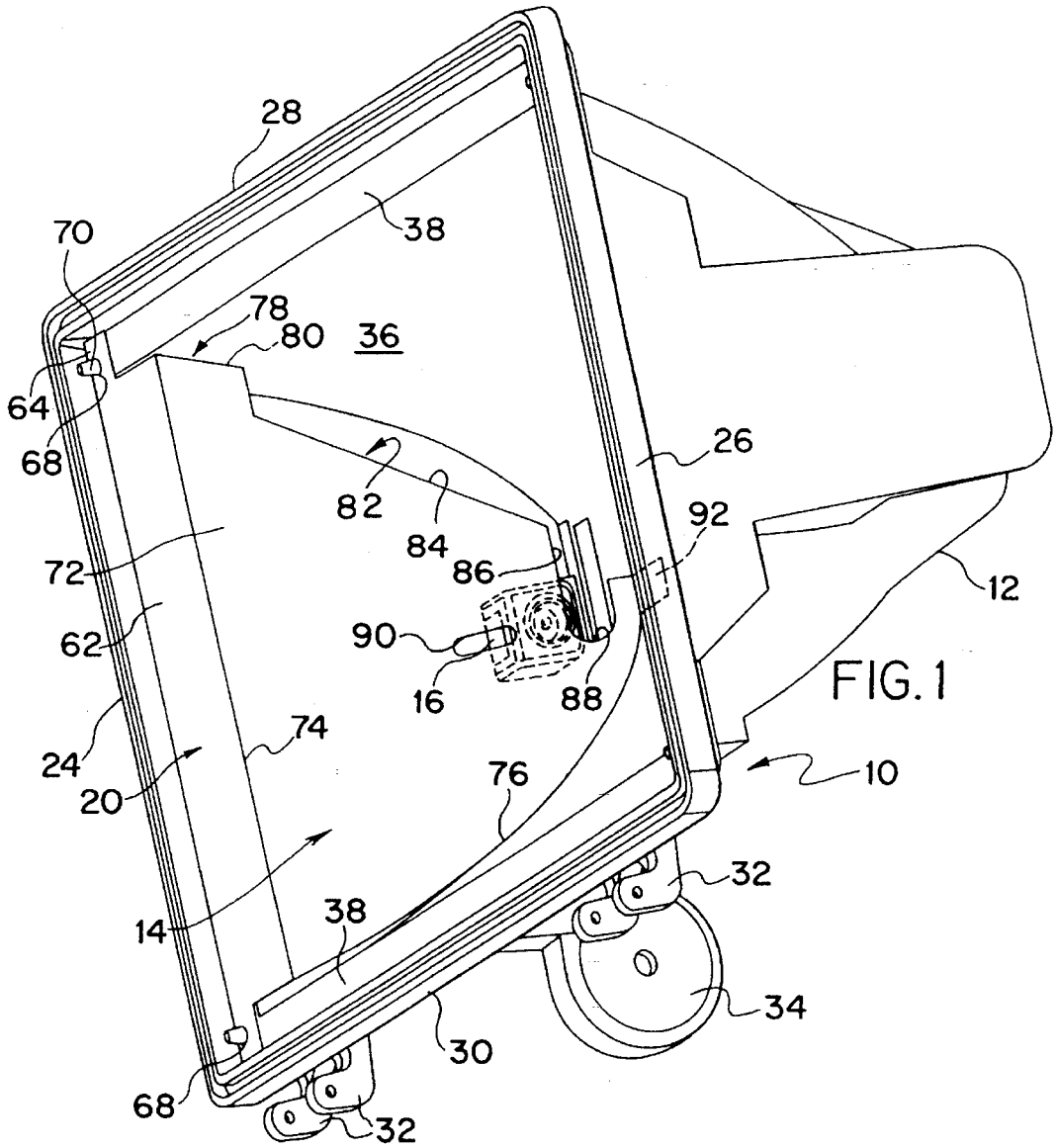
FIG. 1 is a perspective view of a lighting fixture according to the present invention with the pivotally mounted lens cover removed.
Figure 2:
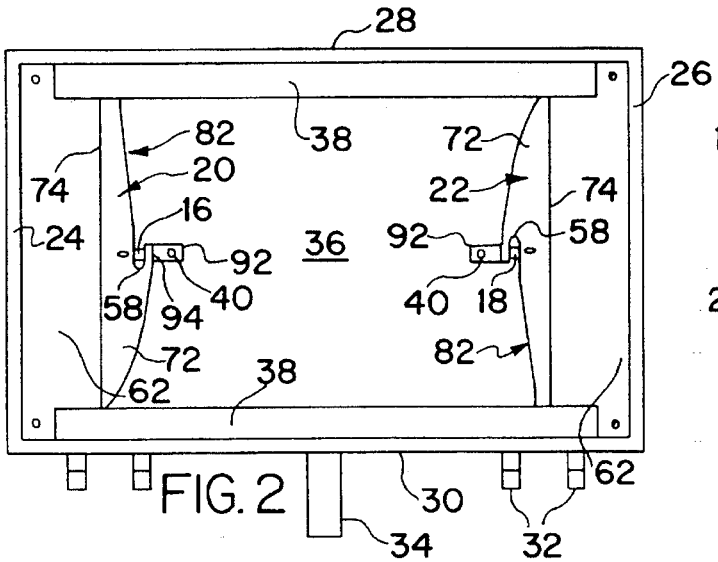
FIG. 2 is a front elevational view of the lighting fixture of FIG. 1.

Referring initially to FIGS. 1 and 2, the lighting fixture 10 of the present invention comprises a housing 12. Housing 12 has a lamp cavity 14 in which electrical sockets 16 and 18 and side barriers 20 and 22 are located.

Housing 12 comprises opposite sides 24 and 26, a top end 28 and a bottom end 30. Lamp cavity 14 is defined between housing sides 24 and 26 and housing ends 28 and 30.

The housing structure is conventional and is formed as a unitary, one piece casting of aluminum. In forming the casting, the top and bottom ends of the housing are formed by housing walls which generally converge toward one another. The housing walls defining the sides are generally parallel. Hinge brackets 32 depend from housing bottom end 30 and are provided for hingedly mounting a lens cover for the fixture. The lens cover, as is conventional, can extend over the open front face of the housing to enclose the bulb within the housing. For re-lamping operations, the lens is unlatched and then pivoted downwardly to open the front face of the housing.

A mounting lug 34 also depends from the housing bottom end 30. Mounting lug 34 is mounted along the central line of the lighting fixture and permits the lighting fixture to be tilted to an adjusted angle.

The closed back surface of lamp cavity 14 in housing 12 is covered by a curved reflector 36. The curved reflector 36 conforms to the internal configuration of the housing. The free ends of the reflector are provided with planar flanges 38. The planar flanges abut corresponding shoulders provided on the housing adjacent the open front face of the housing. The inner most portion of the reflector is secured to the housing by screws 40 which pass through openings in the curved reflector and are threadedly received in internally threaded bores 42 in the housing. Screws 40 and bores 42 also assist in retaining barriers 20 and 22 in place within the housing.

Sockets 16 and 18 are similar and are supported within housing 12 in a mirror image orientation. Thus, only one socket will be described. The sockets themselves are conventional, and thus, are not described in detail.

Figure 3:
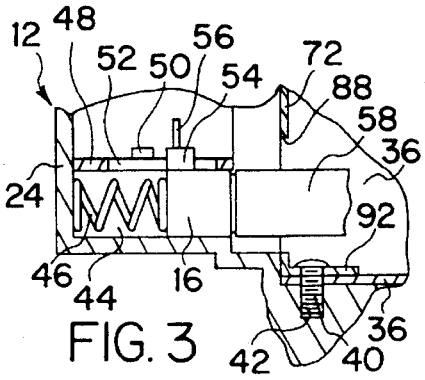
FIG. 3 is a partial side elevational view in cross-section of the lighting fixture of FIG. 1, with a double-end tubular lamp installed.

As best illustrated in FIG. 3, socket 16 is slidably mounted in a guide recess 44 formed within the internal configuration of housing 12 adjacent side 24. The guide recess and the socket are rectangular in transverse cross-sectional configuration such that the socket can only slide axially within the recess. A spring 46 compressed between socket 16 and the wall of side 24 to exert a biasing force on socket 16 in a direction toward socket 18. A suitable stop lip is formed on the housing and extends partially into the guide recess at the end of the guide recess remote from side 24 to maintain the socket within the guide recess under the biasing force.

An end plate 48 is mounted above the socket and guide recess to maintain the socket within the guide recess. The plate is secured in position by screws 50 which pass through openings in the plate and threadedly engaged internally threaded bores in housing 12. The plate has an elongated aperture 52 for receiving projection 54 on socket 16. When the socket moves axially under or against the bias of spring 46, projection 54 extends through and moves along elongated aperture 52. Wiring 56 passes through projection 54 and aperture 52 in the conventional manner and through the housing for coupling to the circuit for the lighting fixture. A double-end lamp 58 with a tubular configuration is connected to socket 16.

Each of the reflective side barriers 20 and 22 are substantially identically formed. However, the side barriers are mounted in reversed positions. In this manner, only a single side barrier configuration need be formed to provide both side barriers 20 and 22. Only one side barrier is described in detail.

Side barrier 20 is formed of an unitary piece of reflective sheet metal material. The sheet metal material is cut and bent into the configuration illustrated in FIGS. 1–3.

Each reflective barrier comprises three separate portions located in three separate planes. Each portion is substantially planar. First portion 62 is generally rectangular with two axially protruding flanges 64 and 68. The flanges are located adjacent the longitudinal free edge of flange 62 and have openings 68. The openings receive pegs 70 protruding integrally from housing 12. First portion 62 overlies a shoulder recessed within the front opening of the housing from which pegs 70 protrude to support the reflective barrier.

Second portion 72 is attached to first portion 62 along a perpendicular fold line 74. The second portion is generally triangular in shape tapering in a direction from first portion 62 and into lamp cavity 14. A first peripheral edge 76, forming one side of the generally triangular second portion, is curved from the base at fold line 74 to the apex adjacent the closed back end of the lamp cavity. The curvature of peripheral edge 76 substantially corresponds to the curvature of the interior of housing 12 and of curved reflector 36.

The other peripheral edge 78 has an initial curved part 80 adjacent fold line 74. At a relatively short distance from fold line 76, sections of the second portion are cut away to form a lamp channel 82 in the reflective barrier. The channel has a first portion 84 extending along peripheral edge 78 of the reflective barrier. The first portion of the lamp channel is adjacent housing end 28, and terminates at a distance spaced from the reflective barrier second portion apex. A second portion 86 of lamp channel 82 extends from first portion 84 at an obtuse angle so as to be in a general vertical direction within the housing. Lamp channel second portion 86 terminates at an access opening 88 coaxially aligned with electrical sockets 16 and 18. Lamp channel 82 and access opening 86 have transverse dimensions sufficiently large to receive lamp 58 with a clearance fit.

An elongated opening 90 is formed in the second portion along its center line and at a distance from opening 88 in the direction of first portion 62. Elongated opening 90 permits the installer to view the socket from the open front end of the housing to facilitate the insertion of the lamp end connector or terminal into the socket.

The third portion 92 of the reflective barrier extends generally perpendicularly from second portion 72 along a fold line 94. The third portion extends in a direction from the second portion opposite to the direction of extension of first portion 62. The configuration of the third portion is that of a rectangular tab having a bore for receiving screw 40 to secure the reflective barrier to the housing. The reflective barrier is positively secured to the housing by the engagement with pegs 70 and screw 40.

By forming and mounting reflective side barriers 20 and 22 in this manner, the barriers are adjacent housing sides 24 and 26, respectively, and overlie sockets 16 and 18, respectively. Each socket is located between the respective housing side and the respective barrier, and is recessed behind the respective barrier by a predetermined distance.

With the reversed positions of reflective barriers 20 and 22, lamp channel 82 of barrier 20 is located adjacent top end 28 of housing 12. However, lamp channel 82 of reflective barrier 22 is located adjacent bottom end 30 of the housing.

To insert a lamp 58 and to connect the lamp electrically to the sockets, one end of the lamp is inserted through one reflective barrier opening 88 into the adjacent socket. The opposite end of the lamp is then pivoted into and moved along lamp channel 82 of the opposite reflective barrier from its initial insertion in first portion 86. Then, the opposite lamp end is moved vertically within second portion 86 of the lamp channel. The first inserted end is then pushed in an outward direction to compress the spring of its socket in an axial direction. This axial movement of the lamp enables the second inserted or opposite lamp end to be placed within its respective socket. The lamp can then be released, enabling the lamp to be properly centered as the springs of the two sockets oppose each other. In this position, the lamp will extend through openings 88 in reflective barriers 20 and 22 and electrically engage sockets 16 and 18.

The recessing of the sockets behind the barriers by distance substantially greater than the axial length of the end connectors or terminals on the lamp fully recesses the end connectors behind the barriers during lamp installation. This recessing of the lamp end connectors behind the barriers during the lamp insertion process prevents the installer from touching the end connectors or terminals of the lamp during the insertion process, thereby preventing shock.

While a particular embodiment has been chosen to illustrate the invention, it will be understood by those skilled in the art that various changes and modifications can be made therein without departing from the scope of the invention as defined in the appended claims.

What is claimed is:

1. A lighting fixture for a double-end lamp, comprising:

a housing defining a lamp cavity between opposite sides and top and bottom ends thereof;

first and second electrical sockets adjacent said opposite sides of said housing for receiving and making electrical connection with lamp end connectors, said first socket facing said second socket in said lamp cavity;

first and second side barriers adjacent said opposite sides and overlying said sockets such that each of said sockets is located between the respective housing side and the respective barrier and is recessed behind the respective barrier by a predetermined distance; and first and second openings in said first and second barriers, respectively, coaxially aligned with said sockets along a lamp axis to permit the lamp to extend through said openings and connect the lamp to said sockets; and a first channel in said first barrier, said first channel having a first portion extending along a peripheral edge of said first barrier adjacent one of said ends and a second portion extending from said first portion and terminating at said first opening.

2. A lighting fixture according to claim 1 wherein said second portion of said first channel extends vertically from said peripheral edge to said first opening.

3. A lighting fixture according to claim 2 wherein said housing comprises an open front face;

said first portion of said first channel extends in a direction away from said front face.

4. A lighting fixture according to claim 3 wherein said first portion of said first channel extends along a top peripheral edge of said first barrier.

5. A lighting fixture according to claim 1 wherein said second barrier comprises a second channel having a first portion extending along a peripheral edge of said second barrier adjacent the other of said ends and a second portion extending from said first portion of said second channel and terminating at said second opening.

6. A lighting fixture according to claim 5 wherein said second barrier is a mirror image of said first barrier.

7. A lighting fixture according to claim 5 wherein each of said sockets is slidably mounted in guide means for axial movement toward and away from the other socket, and is spring biased toward the other socket.

8. A lighting fixture according to claim 1 wherein said barriers comprise reflective surfaces.

9. A lighting fixture according to claim 8 wherein said housing comprises a reflective member extending between said barriers.

10. A lighting fixture according to claim 1 wherein said second socket is slidably mounted in guide means for axial movement toward and away from said first socket.

11. A lighting fixture according to claim 10 wherein said second socket is spring biased toward said first socket.

12. A lighting fixture for a double-end lamp, comprising:

a housing having an open front face and defining a lamp cavity between opposite sides and top and bottom ends thereof;

first and second electrical sockets adjacent said opposite sides of said housing for receiving and making electrical connection with lamp end connectors, said first socket facing said second socket in said lamp cavity, each of said sockets being slidably mounted in guide means in said housing for axial movement toward and away from the other socket and being spring biased toward the other socket;

first and second reflective side barriers adjacent said opposite sides and overlying said sockets such that each of said sockets is located between the respective housing side and the respective barrier and is recessed behind the respective barrier by a predetermined distance;

first and second openings in said first and second barriers, respectively, coaxially aligned with said sockets along a lamp axis to permit the lamp to extend through said openings and connect the lamp to said sockets;

a first channel in said first barrier, said first channel having a first portion extending in a direction away from said front face along a top peripheral edge of said first barrier adjacent said top end and a second portion extending vertically from said first portion of said first channel and terminating at said first opening;

a second channel in said second barrier, said second channel having a first portion extending in a direction away from said front face along a bottom peripheral edge of said second barrier adjacent said bottom end and a second portion extending vertically from said first portion of said second barrier and terminating at said second opening; and a reflective member extending between said first and second barriers.

* * * * *